United States Patent [19]

Kessler et al.

[11] 4,265,407

[45] May 5, 1981

[54] METHOD OF PRODUCING A COAL-WATER SLURRY OF PREDETERMINED CONSISTENCY

[75] Inventors: Richard V. Kessler; Roger J. Corbeels, both of Wappingers Falls, N.Y.

[73] Assignee: Texaco Inc., White Plains, N.Y.

[21] Appl. No.: 57,222

[22] Filed: Jul. 13, 1979

[51] Int. Cl.[3] ..... B02C 17/00

[52] U.S. Cl. ..... 241/21; 241/44; 241/101 B; 241/135

[58] Field of Search ..... 241/21, 137, 41, 42, 241/44, 101 B, 170, 171, 81, 135, 25, 30, 151, 134

[56] References Cited

U.S. PATENT DOCUMENTS

| | | | |
|---|---|---|---|
| 2,421,648 | 6/1947 | Pickens | 241/21 |
| 2,826,370 | 3/1958 | Weston | 241/81 X |
| 3,606,173 | 9/1971 | Rowland, Jr. | 241/81 X |

*Primary Examiner*—Mark Rosenbaum

*Attorney, Agent, or Firm*—Carl G. Ries; Robert A. Kulason; Henry C. Dearborn

[57] ABSTRACT

A method of producing a thick slurry of powdered coal and water. It includes feeding less coal than is required for the thick slurry into a ball mill, and introducing all of the water required so that a thin slurry is produced. The remaining coal required is pulverized in a dry grinder, and the thin slurry and dry powdered coal are mixed to produce the desired thick slurry.

4 Claims, 2 Drawing Figures

METHOD OF PRODUCING A COAL-WATER SLURRY OF PREDETERMINED CONSISTENCY

BACKGROUND OF THE INVENTION

1. Field of the Invention

This invention concerns the handling of powdered coal, in general. More specifically, it relates to an efficient process of mixing a relatively thick slurry of powdered coal.

2. Description of the Prior Art

It has been found that there are difficulties in preparing a slurry of powdered coal and water, particularly when the desired slurry is relatively thick. Slurries which have been employed in connection with the handling of powdered coal in pipeline transport, have been relatively thin.

While there is an old suggestion relating to mixing of concrete for construction, which described mixing with a limited amount of water to obtain some wetting of the concrete constituents followed by adding additional water, it concerned only concrete mixing. Also, it was concerned with compressed air transportation of the concrete. That suggestion is contained in U.S. Pat. No. 1,534,008 to Bongardt issued April 14, 1925.

It is an object of this invention to provide a method that facilitates preparation of a relatively thick powdered coal and water slurry.

SUMMARY OF THE INVENTION

Briefly, the invention concerns an efficient method of preparing a coal slurry having a predetermined thickness. The method comprises the steps of feeding less mined coal than the quantity required for said slurry into a ballmill, and introducing the total quantity of water required for said slurry into said ballmill to produce a powdered coal slurry. It also comprises grinding the remaining quantity of mixed coal for said slurry in a dry grinder to produce dry powdered coal, and mixing said thin slurry with said dry powdered coal to produce said coal slurry having a predetermined thickness.

Again briefly, the invention concerns a method of producing a coal-water slurry having a predetermined consistency. The method comprises grinding a portion of the required coal in a wet ballmill, and adding dry powdered coal to the effluent from said wet ballmill plus mixing therewith to produce said slurry.

Again briefly, the invention concerns an efficient method of preparing a coal slurry having a high percentage solids. The method comprises the steps of continuously feeding a regulated amount of mined coal into a ballmill. It being less than the amount for said high percentage solids slurry. And, continuously introducing the total amount of water into said ball mill that will be required to produce said high percentage solids slurry which produces an easily pumpable relatively thin powdered coal slurry. It also comprises pumping said thin slurry to a holding container, and holding said thin slurry for controlled delivery to a mixer. It also comprises continuously grinding another regulated amount of mined coal in a dry grinder to produce dry powdered coal, and delivering said dry powdered coal to a silo for temporary storage. It also comprises continuously delivering a regulated amount of said dry powdered coal to said mixer and mixing said thin slurry and said dry powdered coal to form said coal slurry having said high percentage of solids.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

Particularly in certain types of coal gasification processes, there is employed the introduction of powdered coal for gasification and it has been proposed that this powdered coal may be introduced by extrusion in order to accomplish the desired mixture of solids and water without any excess water in the coal to be gasified. Such a coalwater slurry or mixture is quite thick and consequently involves a problem in producing the desired mixture.

Figure 1:
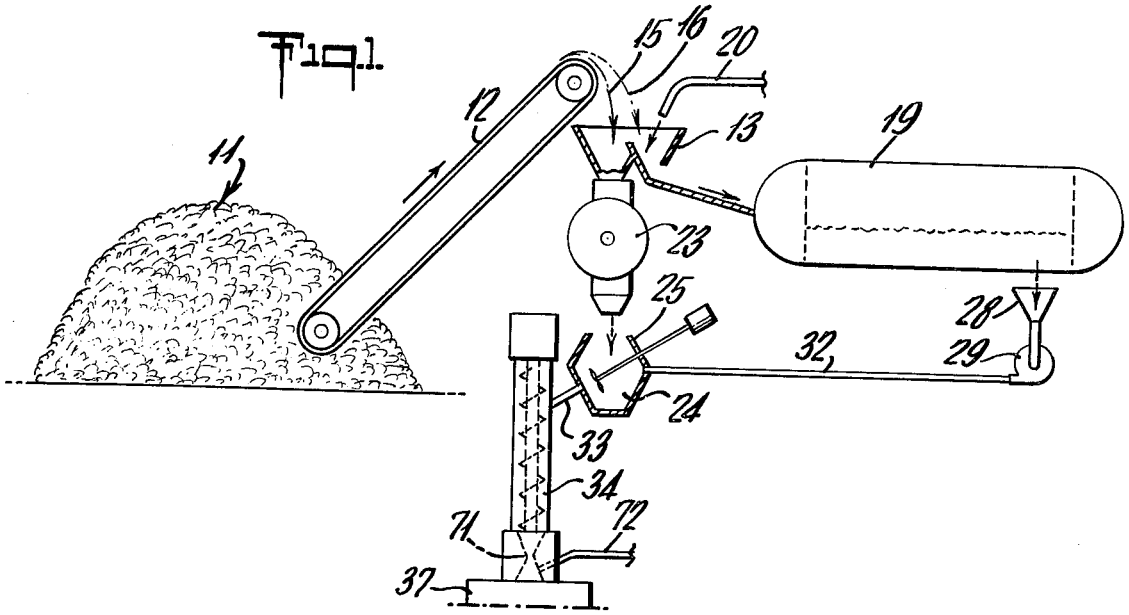
FIG. 1 illustrates the various elements, schematically indicated, that are used in carrying out the steps according to one modification of the invention.

It has been found that dry powdered coal tends to be quite fluffy and hydrophobic so that there is a problem in overcoming the surface tension resistance to wetting of the coal in this form. One proposed method is indicated by the schematic illustration of FIG. 1. Thus, in FIG. 1, there is shown a supply of mined coal 11 that is fed by a conveyer 12 into a divided funnel 13 where it is divided into two parts, as indicated by arrows 15 and 16. In this manner, less than the quantity required for a predetermined slurry of powdered coal and water, is fed into a ballmill 19. At the same time, the total quantity of water that is required for the desired final consistency of the coal-water slurry, is introduced into the ballmill in any feasible manner, e.g. there is a water supply pipe 20 that is directed into one side of the divided funnel 13. In this manner, the portion 16 of the mined coal is introduced into the ballmill 19 with the total quantity of water. Then the grinding process produces a relatively thin powdered coal slurry.

The remaining quantity of the mined coal, as indicated by the arrow 15, goes into a dry grinder 23 from which it is introduced into a mixing chamber 24 of any feasible type of mixer 25.

The mixer 25 also receives in its chamber 24 the thin slurry produced in the ballmill 19. This thin slurry goes via any feasible conveyance system e.g. that indicated schematically by a funnel 28 which is connected to the input of a centrifugal pump 29. The thin slurry then goes over a pipe 32 to be introduced into the chamber 24 of the mixer 25 for mixing with the dry powdered coal from the dry grinder 23. Here a slurry having a predetermined desired thickness is produced. It then goes out over a conduit 33 into the screw feed of an extruder 34. In this manner an extrudate having desired properties is formed for introduction into a coal gasification generator 37.

Figure 2:
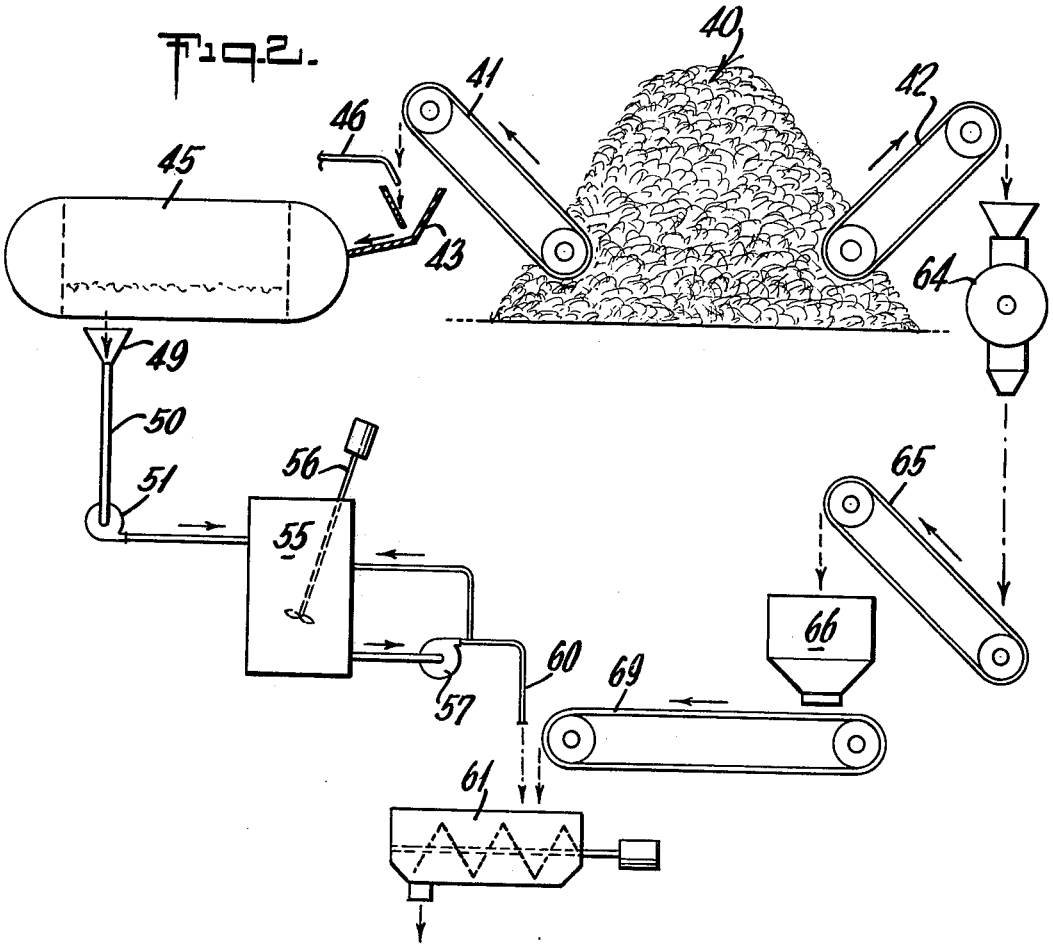
FIG. 2 is another schematic illustration showing a different set of elements employed for carrying out the steps of the invention, according to another modification thereof.

FIG. 2 illustrates another schematic layout showing other apparatus that may be employed in somewhat different form and/or sequences to produce the desired predetermined coal-water slurry of a relatively thick consistency. In this case there is a quantity of mined coal 40 that is conveyed separately on each of two conveyers 41 and 42. The coal on conveyer 41 goes to an inlet 43 into a wet ballmill 45, along with the total quantity of water that will be required for the final desired thickness of the slurry. Such water may be introduced through a water supply pipe 46, indicated.

The wet ballmill 45 will produce a thin slurry mixture which goes out from the ballmill 45 via a funnel 49 and through a pipe 50 to a centrifugal pump 51. This thin slurry then is delivered to a holding container 55. Here, it may be kept in circulation by having a mixing rotator 56 as well as a recirculating pump 57, if desired. It may also be delivered through a pipe 60 to a final mixer 61.

There will be a separate quantity of the mined coal 40 which is delivered via the conveyer 42 to a dry grinder 64. Then, dry powdered coal from the dry grinder 64 will be delivered via any feasible means such as a conveyer 65 to a silo 66. From there, a controlled amount of the dry powdered coal will be carried via a conveyer 69 to the mixer 61. Here, the mixer 61 will produce the desired slurry which has the high percentage solids for a particular use, e.g. to be extruded in relatively solid form. The latter is the manner of introducing such powdered coal with a predetermined percentage water, into a coal gasification high pressure chamber. It will be understood that such particular use is not illustrated, except schematically in FIG. 1 where the extruder 34 is schematically shown with a nozzle 71 and a conduit 72 for introducing a desired gas such as oxygen with the extrudate from extruder 34.

While particular embodiments of the invention have been described above in accordance with the applicable statutes, this is not to be taken as in any way limiting the invention but merely as being descriptive thereof.

We claim:

1. Efficient method of preparing a coal and water slurry having a predetermined thickness from mined coal and a predetermined total quantity of water, comprising the steps of, feeding less of said mined coal than required for said slurry into a ballmill, introducing said total quantity of water required for said slurry into said ballmill to produce a relatively thin powdered coal slurry, grinding the remaining quantity of said mined coal required for said slurry in a dry grinder to produce dry powdered coal, and mixing said thin slurry with said dry powdered coal to produce said coal and water slurry having a predetermined thickness.

2. Efficient method according to claim 1, wherein said steps are continuous.

3. Efficient method according to claim 2, wherein said step of feeding less of said mined coal comprises regulating said less mined coal to produce an easily pumpable relatively thin powdered coal slurry.

4. Efficient method of preparing a coal and water slurry having a high percentage solids from mined coal and a predetermined total amount of water, comprising continuously feeding a regulated amount of said mined coal into a ballmill being less than necessary for said high percentage solids slurry, continuously introducing said total amount of water into said ballmill required to produce said high percentage solids slurry to produce an easily pumpable relatively thin powdered coal and water slurry, pumping said thin slurry to a holding container, holding said thin slurry for controlled delivery to a mixer, continuously grinding another regulated amount of said mined coal in a dry grinder to produce dry powdered coal, delivering said dry powdered coal to a silo for temporary storage, continuously delivering a regulated amount of said dry powdered coal to said mixer, and mixing said thin slurry and said dry powdered coal to form said coal and water slurry having said high percentage solids.

* * * * *